US005226375A

United States Patent [19]

Fukuda

[11] Patent Number: 5,226,375

[45] Date of Patent: Jul. 13, 1993

[54] BOILER AND OTHER COMBUSTION CHAMBERS AND A METHOD FOR MIX-COMBUSTING COAL AND RUBBER

[75] Inventor: Yasumichi Fukuda, Miyagi, Japan

[73] Assignee: Toyo Tire & Rubber Co., Ltd., Osaka, Japan

[21] Appl. No.: 885,585

[22] Filed: May 19, 1992

[30] Foreign Application Priority Data

May 22, 1991 [JP] Japan ..... 3-117490

[51] Int. Cl.[5] ..... F23G 5/00

[52] U.S. Cl. ..... 110/346; 110/101 PC; 110/111; 110/115; 110/347

[58] Field of Search ..... 110/346, 248, 257, 267, 110/276, 347, 111, 112, 115, 101 R, 267

[56] References Cited

U.S. PATENT DOCUMENTS 4,326,469 4/1982 Reschly ..... 110/115
4,434,724 3/1984 Kunkel, Jr. ..... 110/115 X
4,485,747 12/1984 Pershing et al. ..... 110/347

FOREIGN PATENT DOCUMENTS 2616776 6/1977 Fed. Rep. of Germany .
852527 10/1960 United Kingdom .

*Primary Examiner*—Edward G. Favors
*Attorney, Agent, or Firm*—Jordan and Hamburg

[57] ABSTRACT

This invention relates to the combustion of metal-containing scrap rubber such as used tires in a combustion chamber equipped with a traveling-grate stoker without allowing binding of molten metal to the stoker for effective utilization of scrap rubber as a fuel for a boiler or the like. On the traveling-grate stoker of the combustion chamber, which travels from a rear part to a front part of the chamber, blocks of coal supplied from a coal feeding port in the front wall of the chamber is cast by a spreader into the chamber to form coal deposits in a substantially uniform thickness on the stoker for combustion. At the same time, scrap rubber is fed from a chute discharging into the combustion chamber through a side wall defining the chamber via a rotary valve built into the chute in adequate amounts and burned on the ash zone formed by already burned coal on the traveling-grate stoker.

4 Claims, 2 Drawing Sheets

BOILER AND OTHER COMBUSTION CHAMBERS AND A METHOD FOR MIX-COMBUSTING COAL AND RUBBER

BACKGROUND OF THE INVENTION

1. Technical Field

The present invention relates to improvements in the combustion chamber for effective utilization of rubber scrap such as used tires and waste from the tire manufacturing process as a fuel for coal-fired boilers or the like and improvements in the method for mix-burning coal and such rubber scrap.

Prior Art

When metal-containing rubber scrap such as used tires are burned at high temperature, the metal contained therein is melted and stuck to the stoker of the combustion equipment. Therefore, generally such rubber scrap has not been utilized as a boiler fuel.

Some rubber scrap has heretofore been reclaimed and used as a fuel for the production of cement or a blast furnace fuel in steel mills but the shipment of rubber scrap such as used tires and wast from a tire manufacturing plant to a site of use, e.g. a blast furnace located in a remote locality, involves much transportation costs. Moreover, if rubber scrap of this type is burned in large quantities, several component materials of the rubber adversely affect the combustion. Mainly for these two reasons, this kind of rubber scrap has so far found little usage.

Furthermore, if a large amount of metal-containing rubber scrap such as automotive tires containing bead wires, steel cords, etc. is burned in a furnace, the molten metal having a greater specific gravity sinks and sticks to the stoker, with the result that the flow of air through the stoker is obstructed or mechanical troubles are encouraged.

In the usual type of furnace, the same problems as above are encountered when it is charged with tires or the like rubber wastes together with other fuels from the same charging port, whether concurrently or sequentially.

To avoid this problem associated with molten metal, Japanese Patent Application Kokai No. 105308/1988 proposed a combustion system in which rubber scrap such as used tires are burned on a fluidized bed formed by sand or the like material, which is to be recycled, in a furnace. This combustion method, however, requires a special equipment and a time-consuming operation for separating the metal from the sand constituting the fluidized bed and, in this sense, is not practically useful.

The present invention overcomes the above problems. Thus, the invention is directed to a boiler or other combustion chamber and a method for burning coal and rubber, scrap together, which solve the problems associated with the disposal of used tires which is currently a major nation-wide problem requiring a neat solution and of refuses from the tire manufacturing process and enable effective utilization of the potential thermal energies of such refuses as fuels.

SUMMARY OF THE INVENTION

The intensive research of the inventor of the present invention led to the finding that the above problems are neatly solved when chips of used tire or other rubber scrap are fed into a furnace in a scattered pattern for combustion over a bed of ashes formed by preburned coal. The present invention has been developed on the basis of the above finding.

The boiler or other combustion chamber according to the present invention comprises a traveling-grate stoker adapted to travel in a counter-current fashion from back to forth between front and back walls thereof, said front wall having a coal feeding port equipped with a spreader capable of scattering coal over said traveling-grate stoker, and a chute discharging into the combustion chamber to form a rubber feeding port and having as built therein a rotary valve for isolating from external atmosphere and metering out rubber chips from above as disposed at a side wall of the chamber above the level of said traveling-grate stoker, so that chips of rubber may be supplied in necessary amounts onto the traveling-grate stoker without air of atmosphere flowing into chamber though chute.

In the above combustion chamber construction, coal blocks fed from said coal feeding port a the front wall are cast in ballistic trajectories by said spreader into the combustion chamber, with comparatively large and heavy blocks reaching far into the depth of the chamber and comparatively small and lightweight blocks falling closer to the front wall to form a substantially uniform deposit on the traveling-grate stoker. As the stoker travels forwards, the coal cast deeper is progressively burned into ashes and when it reaches the approximate center of the combustion chamber, it has formed a thick ash zone.

On the other hand, chips of used tires or other rubber waste are fed through by said chute provided at the side wall. Since these rubber, chips vary in shape and orientation, they encounter varying sliding resistance during passage through the chute so that they settle on the ash zone formed by burned coal in a broadly scattered pattern. Moreover, since the rubber chips are fed into the combustion chamber in predetermined amounts due to a constant rotation of the rotary valve built into the chute, it does not happen that they are piled up even when fed in a large quantity at a time. Rather, the rubber chips are distributed almost uniformly and burned on the ash zone.

Therefore, even when the high temperature generated by the burning rubber causes the metal contained to melt and drip down, the molten metal is solidified in the ash zone as it is cooled by the air supplied from below the traveling-grate stoker so that the metal does not bind directly to the stoker grate to cause clogging of the stoker and, hence, does not interfere with combustion.

Therefore, by mix-burning coal and rubber in the combustion chamber of the invention, rubber scrap such as used tires which are difficult to dispose of and can be a major source of pollution may be effectively utilized as a fuel for boilers and the like. As a consequence, the invention not only resolves the environmental problems associated with the disposal of large quantities of used tires or rubber scrap in the tire manufacturing plant but contributes to oil or coal conservation.

The chute provided at the side wall of the combustion chamber preferably discharges into the chamber in an upper position thereof within a span corresponding to 40 to 80% of the distance from the front wall to the rear wall of the chamber. In this arrangement, rubber chips are more certainly caused to settle on the thick ash zone in an intermediate position of the traveling-grate stocker and may undergo efficient combustion.

The rotary valve is preferably so constructed that a rotor is driven at a constant rate in gas tight sealing relation with a rotor housing during the phase between a feed side and a discharge side. Such a rotary valve virtually does not allow communication between the combustion chamber and the external atmospheric air. Therefore, despite provision of the rubber feeding port, it does not happen that unwanted air flows into the combustion chamber, which is under reduced pressure, to lower the internal temperature and interfere with stable combustion.

Moreover, when coal is burned together with tire chips in this manner, the internal fouling of the furnace and the formation of nitrogen oxides are decreased.

The combustion chamber of the present invention is not only useful for the combustion of rubber waste but can be used for the combustion of other combustible wastes such as refuse plastics and wood.

BRIEF DESCRIPTION OF THE DRAWINGS

FIG. 1 is a longitudinal section view showing the construction of a combustion chamber for a boiler or the like;

THE PREFERRED EMBODIMENT OF THE INVENTION

Figure 1:
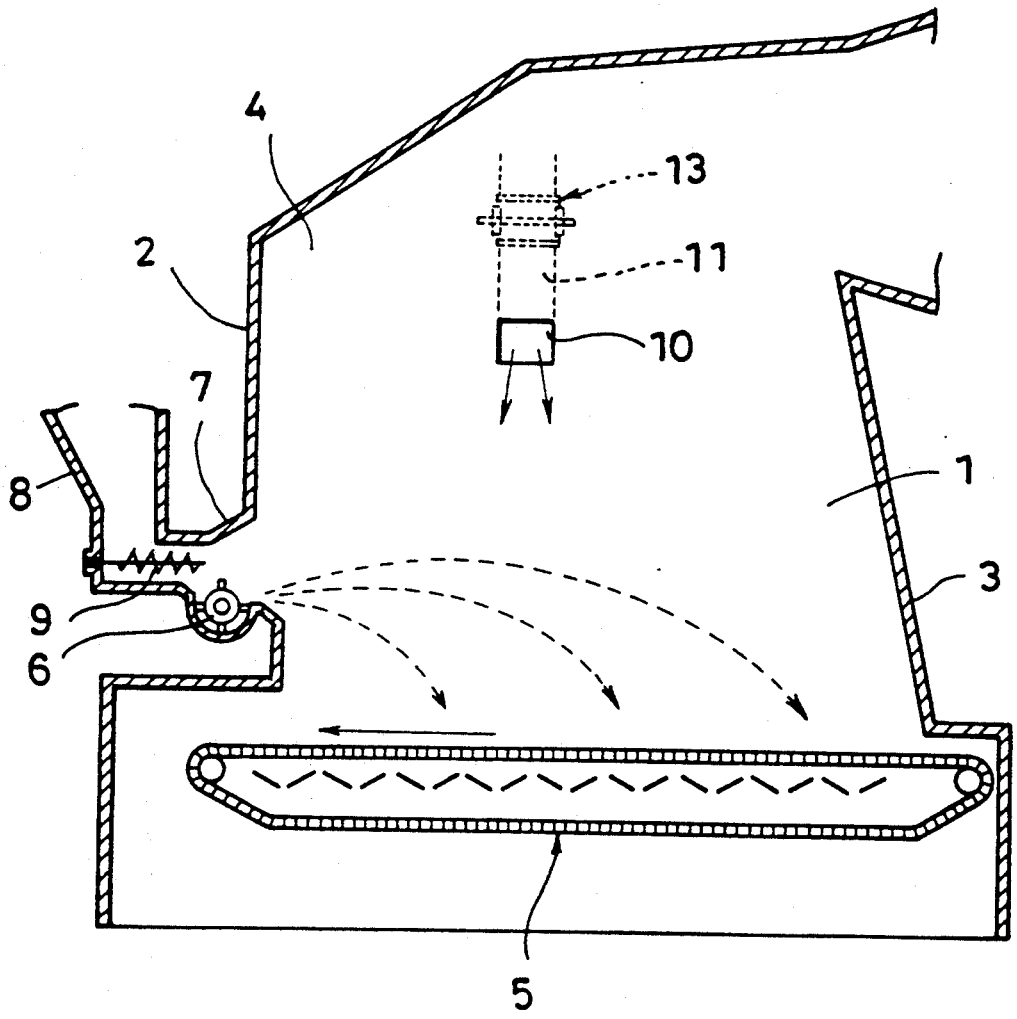

The preferred embodiment of the invention is now described in detail with reference to the accompanying drawings.

The reference numeral 1 indicates a boiler combustion chamber which is defined by a front wall 2, a rear wall 3 and side walls 4. Disposed below and between said front wall 2 and rear wall 3 is an endless traveling-grate stoker 5 which has a broad upper surface and travels from the rear side to the front side of the combustion chamber 1.

The front wall 2 is provided with a coal feeding port 7 having a spreader 6. Indicated at 6*a* is a rotor of said spreader 6. A charging hopper communicating with said coal feeding port 7 is indicated at 8, and a feeder, which may for example be a screw feeder, is indicated at 9.

The reference numeral 10 indicates a rubber feeding port communicating with a rectangular tube shaped chute 11, which is provided at least one of side walls 4 of the combustion chamber 1 within a span corresponding to 40–80% of the distance between the front wall 2 and the rear wall 3. One end of the chute 11 communicating with the rubber feeding port 10 extends through the side wall 4 and discharges into the combustion chamber 1 to form the rubber feeding port 10, with the other end extending obliquely upwards, externally of the combustion chamber 1, to form a rectangular tube 11*a* which is flared to form a charging hopper 12. This tube 11*a* of the chute 11 is disposed at an angle of 30°–80° with respect to the horizontal so that the rubber chips supplied into the charging hopper 12 slide down the chute 11 under their own weight.

Figure 2:
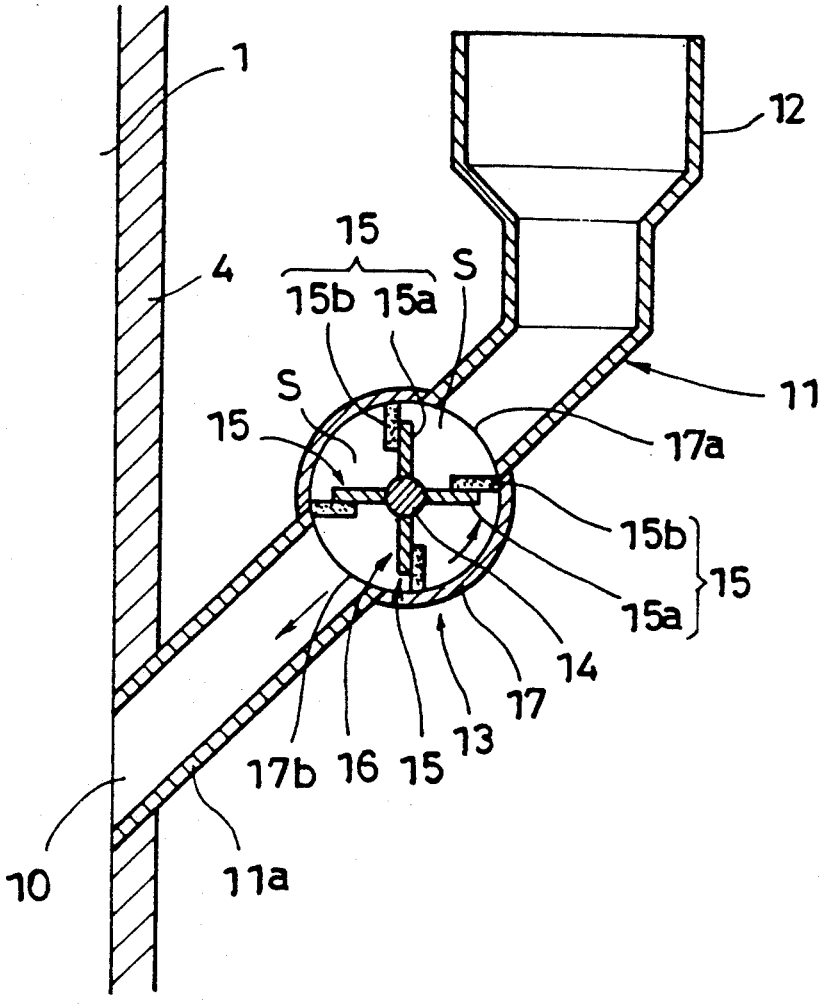
FIG. 2 is a longitudinal section view showing a rubber feeding port.

Provided intermediate along the length of said chute 11 is a cylindrical rotary valve 13 adapted to feed a predetermined quantity of rubber chips in a time-series. As shown typically in FIG. 2, this rotary valve 13 comprises a rotor 16 consisting of a shaft 14, 4 or 5 to 8 vanes 15 mounted in parallel with its axis on the circumferential surface of said shaft 14 and a housing 17 enclosing said rotor 16, so that as the rotor 16 is driven, it feeds rubber chips, supplied from above, in a time-series. Each of the vanes 15 consists of a flat iron plate 15*a* and a resilient sealing member 15*b* of heat-resisting rubber so that the sealing member 15*b* may remain in sliding contact with the inner circumferential surface of the housing 17 to insure an air tight seal during the phase between the feed side and the discharge side. The reference numerals 17*a* and 17*b* indicate a feed port and a discharge port, respectivity, of the housing 17, both of which are communicating with the tube 11*a*.

In the above combustion chamber construction, blocks of coal supplied from the charging hopper 8 and fed by the feeder 9 are broadcast by the spreader 6 in ballistic trajectories through the coal feeding port 7 onto the traveling-grate stoker 5 within the combustion chamber 1. In this process, larger coal blocks are cast far into the combustion chamber 1 and smaller ones only over short distances so that the coal is deposited on the traveling stoker 5 in a substantially uniform stratified distribution.

Figure 3:
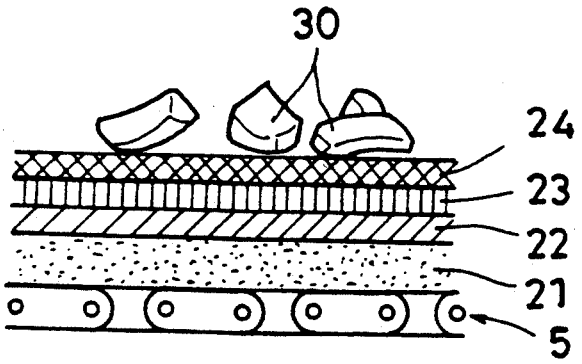
FIG. 3 is a schematic diagram showing a pattern of deposits on the traveling-gate stoker.

The stoker 5 travels from the rear side to the front side of the combustion chamber 1 and the coal on the stoker 5 burns as it moves together with the traveling-grate stoker. Moreover, as fresh coal is fed in superimposition and burned, the deposit on the stoker 5 in the center of the combustion chamber 1 is made up, from bottom to top, of an ash zone 21, an oxidation zone 22, a reduction zone 23, and distillation or carbonization zone 24 as schematically shown in FIG. 3.

The rotor 16 of said rotary valve 13 is driven at a constant rate by a motor not shown. As used tires or reject tires manufactured as trial products, each cut into 2 to 40 circumferential fragments, or rubber waste from a tire manufacturing plant are supplied from the charging hopper 12, and as the compartment S defined by two adjacent vanes 15 of the rotary valve 13 comes into registry with the feed port 17*a*, one to several chips, according to cutting size, of rubber enter into the compartment S. Then, as the compartment S comes into registry with the discharge port 17*b* in the opposite phase, the rubber chips slide down the cylindrical chute 10 into the combustion chamber 1. In this manner, rubber fragments are fed into the combustion chamber 1 in a time-series without being fed in a large quantity at a time.

Furthermore, each piece of rubber has a convex surface and a concave surface and the orientation of pieces falling down the chute 11 is not constant. This means that a variation is inevitable in frictional resistance during the downward slide. Therefore, the rubber is almost uniformly distributed on the distillation zone 24 in the intermediate position of the traveling-grate stoker 5 over a certain spread or expanse from the rubber charging port 10 (FIG. 3). It does not happen, therefore, that the rubber chips 30 are deposited locally in a massive pile.

Since the rubber chips fed and distributed as above generates combustible gases on pyrolysis of rubber at a temperature of about 500° C., it burns producing flames. The metal contained in the rubber chips then melt but the molten metal is solidified in the ash zone formed by burned coal in a sufficiently thick layer so that it does not solidify in contact with the stoker and, hence, is not stuck to the stoker grate, with the result that the stoker is not clogged.

Moreover, regardless of the phase of the rotor 16 of rotary valve 13, at least two vanes 15 are in intimate contact with the inner circumferential surface of the rotor housing 17 to maintain an air tight seal between the feed side and discharge side, thus preventing entry of unwanted air into the combustion chamber 1 and insuring stable combustion. Moreover, since the combustion residues are automatically withdrawn by the traveling-grate stoker 5, continuous operation is made feasible and the separation of metal from the ashes is facilitated, thus contributing to reduced operation manpower requirements.

As mentioned above, since coal is burned together with rubber chips, even metal-containing rubber scrap can be utilized as a fuel for boilers and other devices.

When the scrap tire or the like is previously cut into 2–40 pieces and fed, its amount can be readily controlled by adjusting the speed of a constant rotation of the rotary valve, and thus the automatic feeding of rubber scrap is facilitated. Moreover, by adjusting the rotational speed of the rotor 16 of the rotary valve 13, the rate of feeding of tire chips or other rubber scrap can be varied as desired. In addition, the feeding rate for coal can also be controlled by means of the feeder 9. Therefore, even if the steam load varies, it can be readily followed by adjusting the feed rate of coal or chips so that a suitable boiler output can be insured.

Since, in the mix-combustion system of the invention, the ash zone formed by burned coal plays an important part, coal with a higher than usual ash content is preferably used for burning a large amount of rubber. On the other hand, since the high-quality rubber used for tires is mostly composed of hydrocarbons and carbon, the yield of ashes is low and the calorific value is high. Therefore, when the rubber scrap is tire, coal of lower than usual quality can be employed.

Assuming that the coal is of the grade commonly used as a boiler fuel, the ratio of coal to tire chips may be 70:30 through 30:70. If the proportion of coal exceeds 70%, the amount of scrap tires that can be disposed of will be too small for efficient disposal, while the use of coal in a proportion of less than 30% will not provide a sufficient amount of ashes to prevent binding of molten metal to the stoker so that chances for troubles due to stuck metal will be increased.

What is claimed is:

1. A combustion chamber comprising a traveling-grate stoker provided in a lower part thereof between a front wall and a rear wall defining the chamber and adapted to travel from a rear part to a front part of the chamber, said front wall having a coal feeding port equipped with a spreader for scattering coal onto the traveling-grate stoker, and a chute discharging into said combustion chamber to form a rubber feeding port in at least one of side walls defining said combustion chamber above said stoker and having a rotary valve adapted to feed rubber scrap sequentially in adequate amounts to supply them onto an ash zone formed by burned coal on the stoker.

2. The combustion chamber of claim 1 wherein said chute extends through the corresponding side wall within a span corresponding to 40-80% of the distance between said front wall and rear wall and discharging into said combustion chamber.

3. The combustion chamber of claim 1 wherein the rotary valve revolves in air-tight sealing relation during the phase between a feed side and a discharge side of the valve.

4. A method for mix-burning coal and rubber scrap comprising casting blocks of coal into a combustion chamber from a coal feeding port in a front wall thereof with a spreader in such a manner that larger blocks are cast farther into the chamber to form coal deposits in a substantially uniform thickness on a stoker traveling from a rear part to a front part of the combustion chamber to burn the coal on said stoker and, at the same time, feeding a metal-containing rubber scrap into the combustion chamber from a chute discharging into the chamber through at least one of side walls defining the chamber via a rotary valve built into said chute in a predetermined amount in a time-series so as to cast the scrap rubber onto an ash zone formed by burned coal and thereby burn the rubber on said ash zone.

* * * * *